US007238163B1

(12) United States Patent
Fried et al.

(10) Patent No.: US 7,238,163 B1
(45) Date of Patent: Jul. 3, 2007

(54) TREATMENT DEVICE FOR HAND AND WRIST AILMENTS

(76) Inventors: Scott Fried, P.O. 186, 209 Cathcart Rd., Gwynedd Valley, PA (US) 19437; Luke W. Michas, 58 Tum A Lum Cir., Westerly, RI (US) 02837; Jeremy C. Howard, 16 Austin La., Little Crompton, RI (US) 02837; Phil Bussone, 192 Linden, South Hamilton, MA (US) 01982; David J. Moretti, 36 Franklin Heights, Rochester, NH (US) 03867; Sean J. Albert, 95 Rte. 126, Barrington, NH (US) 03825

( * ) Notice: Subject to any disclaimer, the term of this patent is extended or adjusted under 35 U.S.C. 154(b) by 468 days.

(21) Appl. No.: 10/390,844

(22) Filed: Mar. 17, 2003

Related U.S. Application Data

(60) Provisional application No. 60/391,486, filed on Jun. 25, 2002.

(51) Int. Cl.
*A61H 15/00* (2006.01)

(52) U.S. Cl. ..... 601/122; 601/125; 601/126; 601/DIG. 20

(58) Field of Classification Search ..... 601/148, 601/84–106, 15–83, 112–147; *A61H 15/00, A61H 15/02*
See application file for complete search history.

(56) References Cited

U.S. PATENT DOCUMENTS

| | | | | |
|---|---|---|---|---|
| 2,007,737 | A * | 7/1935 | Anderson | 601/122 |
| 2,395,040 | A * | 2/1946 | Curtis | 601/99 |
| 2,512,904 | A * | 6/1950 | Strelecky | 601/122 |
| 2,577,646 | A * | 12/1951 | Cameron | 601/63 |
| 2,657,686 | A * | 11/1953 | Brandenfels | 601/99 |
| 3,389,699 | A * | 6/1968 | Mathers | 601/52 |
| 4,165,737 | A * | 8/1979 | Chapa | 601/19 |
| 4,274,399 | A | 6/1981 | Mummert | |
| 4,522,197 | A | 6/1985 | Hasegawa | |
| 4,577,625 | A | 3/1986 | Lohati et al. | |
| 4,892,090 | A * | 1/1990 | Kaeser | 601/99 |
| 5,080,089 | A | 1/1992 | Mason et al. | |
| 5,297,541 | A | 3/1994 | Hensey | |
| 5,688,208 | A | 11/1997 | Plemmons | |
| 5,792,081 | A | 8/1998 | Cross | |
| 6,315,696 | B1 | 11/2001 | Garrioch | |
| 2005/0021114 | A1* | 1/2005 | Hidaka | 607/112 |

* cited by examiner

*Primary Examiner*—Danton DeMille
(74) *Attorney, Agent, or Firm*—Garcia-Zamor IP Law; Ruy M. Garcia-Zamor

(57) ABSTRACT

A treatment device for a user's hand and/or wrist. The treatment device includes a housing having an outer surface defined at least partially by a membrane adapted for placement against the user's hand and/or wrist. The treatment device creates localized outwardly deformations in the membrane adapted to create a massaging effect in the user's hand and/or wrist.

7 Claims, 14 Drawing Sheets

TREATMENT DEVICE FOR HAND AND WRIST AILMENTS

CROSS REFERENCE TO RELATED APPLICATION

This application claims benefit of and priority from U.S. provisional patent application 60/391,486, filed Jun. 25, 2002, entitled "Treatment Device for Hand and Wrist Ailments" which is hereby incorporated by reference herein in its entirety as if fully set forth.

BACKGROUND

The present invention is generally directed to providing relief from carpal tunnel syndrome, tendinitis and other wrist and hand ailments and, more specifically, is directed to a treatment device for applying therapeutic massage and/or heat treatment.

Millions of workers find themselves experiencing hand and wrist pain on a frequent basis. Chronic pain can result in debilitating circumstances that drastically lower one's quality of life. Carpal tunnel syndrome and repetitive strain injury are two of the most common causes of chronic hand and wrist pain. Chronic pain can lead to depression, loss of livelihood, and scores of other secondary problems.

Many people try to use surgery to correct their carpal tunnel problems. However, most of those people still suffer, and have learned the hard way—after the physical toils and financial expense of surgery—that carpal tunnel is a problem with no easy surgical solution.

Originally, carpal tunnel was mainly experienced by elderly people who had worked hard their entire lives, and then retired to lower activity levels. In the mid 1950's, Doctor George Phalen coined the term "carpal tunnel" to describe their condition, which was thought to be a localized nerve injury at the hand and wrist. The paradigm concerning upper extremity nerve injury taught in medical schools was "all nerve problems in the upper extremities are carpal tunnel." Since these patients had surgery and, because of sedentary lifestyles, died at a fairly young age, the incidence of returning pain symptoms was low and surgery appeared to be a suitable cure to carpal tunnel syndrome. Dr. Phalen did not envision that the straightforward problem he diagnosed and surgically treated would become as complex to treat as it has become today.

Today, carpal tunnel surgeries are often performed with minimal attempts being made to provide a complete pre-surgical diagnosis and to provide patient education to find non-surgical alternatives. Doctors rarely consider recommending activity and lifestyle modifications. Up to thirty percent of patients have recurrent or continued problems with pain and dysfunction after surgery, yet in spite of this, many feel they cannot improve because they have already had corrective surgery.

In the past, the belief that surgery is the best option was often unquestioned. Employers and insurance carriers wanted to believe that there is a quick fix to carpal tunnel and repetitive strain injury. Surgery was encouraged and patients were not told of the failure rates. Today, the recurrence of painful symptoms after undergoing carpal tunnel surgery is thought to be as high as thirty percent.

Many people who have had surgery continue to be symptomatic, but their complaints fall upon deaf ears. Most go back to their work activities and are warned not to complain anymore, or their jobs will be jeopardized. They are told the numbness, tingling and upper arm pain that they experience are to be expected and that "if you work hard, you are going to have some aches and pains."

The concepts of repetitive strain injury, tendonitis and carpal tunnel are misunderstood by many physicians and therapists. With the lack of knowledge and understanding of nerve injuries that permeates the medical community, patients are left to deal with the consequences—the return of their daily pain. They fall through the cracks of a system devastatingly deficient in understanding and treating these diseases.

Clearly what is needed is a treatment device that provides a non surgical alternative to treating hand and wrist ailments; that is preferably capable of applying heat and massage action to the hand and/or wrist of a user; that preferably applies localized, area oscillating massage pressure to the hand and wrist of a user; and that is preferably relatively easy to use as a home treatment tool.

SUMMARY

One embodiment of the present invention is directed to a treatment device for a user's hand and/or wrist. The treatment device includes a housing having a surface defined at least partially by a membrane adapted for placement against the user's hand and/or wrist. Separate portions of a major surface of the membrane are independently supported such that the separate portions can be depressed in varying amounts depending on a shape of the user's hand and/or wrist when the treatment device is positioned with the membrane against the user's hand and/or wrist.

A separate embodiment of the present invention is directed to a treatment device for a user's hand and/or wrist. The treatment device includes a housing having an outer surface defined at least partially by a membrane adapted for placement against the user's hand and/or wrist. A plurality of rollers are disposed in the housing proximate to the membrane. A conveyor is located around the plurality of rollers such that at least one of the plurality of rollers press the conveyor into contact with the membrane. At least one protuberance is disposed on the conveyor. The at least one protuberance creates localized outwardly deformations in the membrane when in contact therewith such that rotation of the conveyor is adapted to create a massaging effect for the user's hand and/or wrist due to contact between the localized outwardly deformations and the user's hand and/or wrist.

A separate embodiment of the present invention is directed to a treatment device for a user's hand and/or wrist. The treatment device includes a housing having an outer surface defined at least partially by a membrane adapted for placement against the user's hand and/or wrist. The treatment device creates localized outwardly deformations in the membrane adapted to create a massaging effect in the user's hand and/or wrist.

BRIEF DESCRIPTION OF THE DRAWINGS

The foregoing summary, as well as the following detailed description of the preferred embodiments of the present invention will be better understood when read in conjunction with the appended drawings. For purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
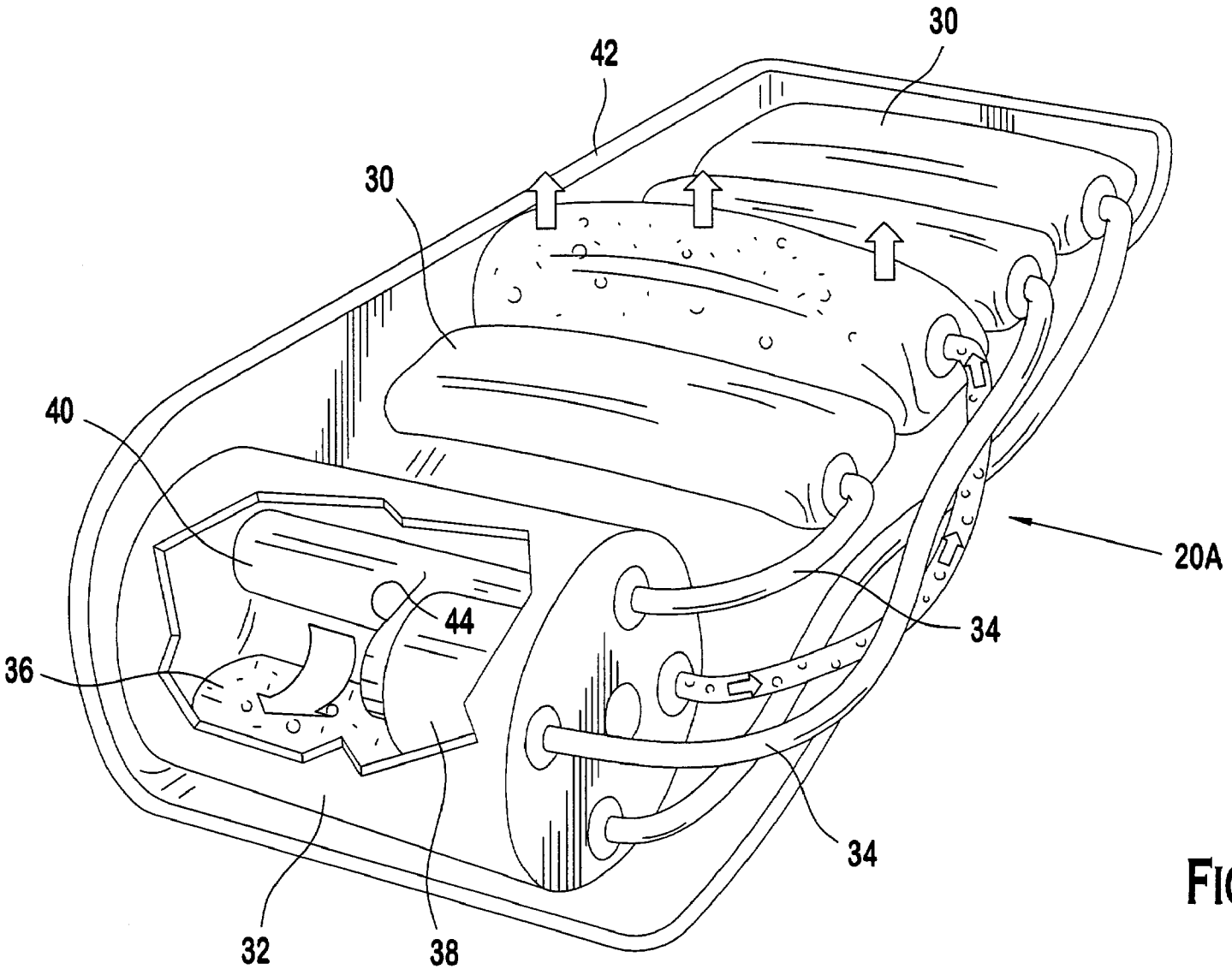
FIG. 1 is a perspective broken away view of a first preferred embodiment of a treatment device according to the present invention, the treatment device preferable uses fluid inflatable bladders to apply heat and/or massage action to the hand and wrist of a user.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the treatment device and designated parts thereof. The terminology includes the words above specifically mentioned, derivatives thereof, and words of similar import. Additionally, the words "a" and "one" are defined as including one or more of the referenced item unless specifically stated otherwise.

Referring to FIGS. 1–15, wherein like numerals indicate like elements throughout, there are shown six preferred embodiments of a treatment device according to the present invention, generally designated 20A–20F, respectively. Briefly stated, each of the treatment devices 20A–20F of the present invention is capable of applying massage action (i.e., oscillating pressure), oscillating massage action, heat, oscillating heat and/or alternating heat and massage action to the wrist and hand 22 of a user. It is preferred that the treatment device 20A–20F is usable as a home treatment device. The treatment device 20A–20F preferably includes a housing 42 having an outer surface defined at least partially by a membrane 100 adapted for placement against the user's hand and/or wrist 22. The treatment device 20A–20F creates localized outwardly deformations 118 in the membrane 100 adapted to create a massaging effect in the user's hand and/or wrist 22.

Six preferred embodiments of the treatment device 20A–20F will be described below. For purposes of brevity and clarity, those features common to more than one embodiment will, in some cases, only be described once. It is understood from this disclosure that generally similar features operate in a generally similar fashion in each of the embodiments of the treatment device 20A–20F unless described otherwise or unless obvious to one of ordinary skill in the art in view of this disclosure.

It is preferred, but not necessary, that each of the treatment devices 20A–20F, and their components parts, be formed of a suitable high strength, non reactive, durable material, such as a suitable polymer. However, those of ordinary skill in the art will appreciate from this disclosure that other materials can be used without departing from the scope of the present invention. It is also preferred that each of the treatment devices 20A–20E is driven by a motor, which can be powered by batteries, electricity supplied by a power cord connection, or any other suitable means of powering a motor. It is preferable that if the treatment device uses a membrane 100, that the membrane 100 is formed of a durable, deformable material, such as neoprene. Those of ordinary skill in the art will appreciate from this disclosure that the membrane can also be formed out of suitable woven fabrics, an elastomer, or a polymer without departing from the present invention. The membrane 100 can be formed of open cell or closed cell material.

It is preferable that each of the embodiments of the treatment device 20A–20F is attached to the hand using hook and loop material 96. The use of hook and loop material 96 allows for ease of adjustment of the treatment device 20A–20F for a user's hand. Those of ordinary skill the art will appreciate from this disclosure, that the treatment device 20A–20F can be incorporated into a glove (preferably made of non-stretchable fabric) without departing from the scope of the present invention.

Each of the treatment devices 20A–20F preferably, but not necessarily, includes a heat generating member 28. It is also preferred that the massage action applied to a user's hand and wrist 22 be capable of application to a localized area of the hand and wrist 22 such that the massage action can oscillate between a distal portion of user's hand and a proximal portion of a user's wrist or arm.

Figure 2:
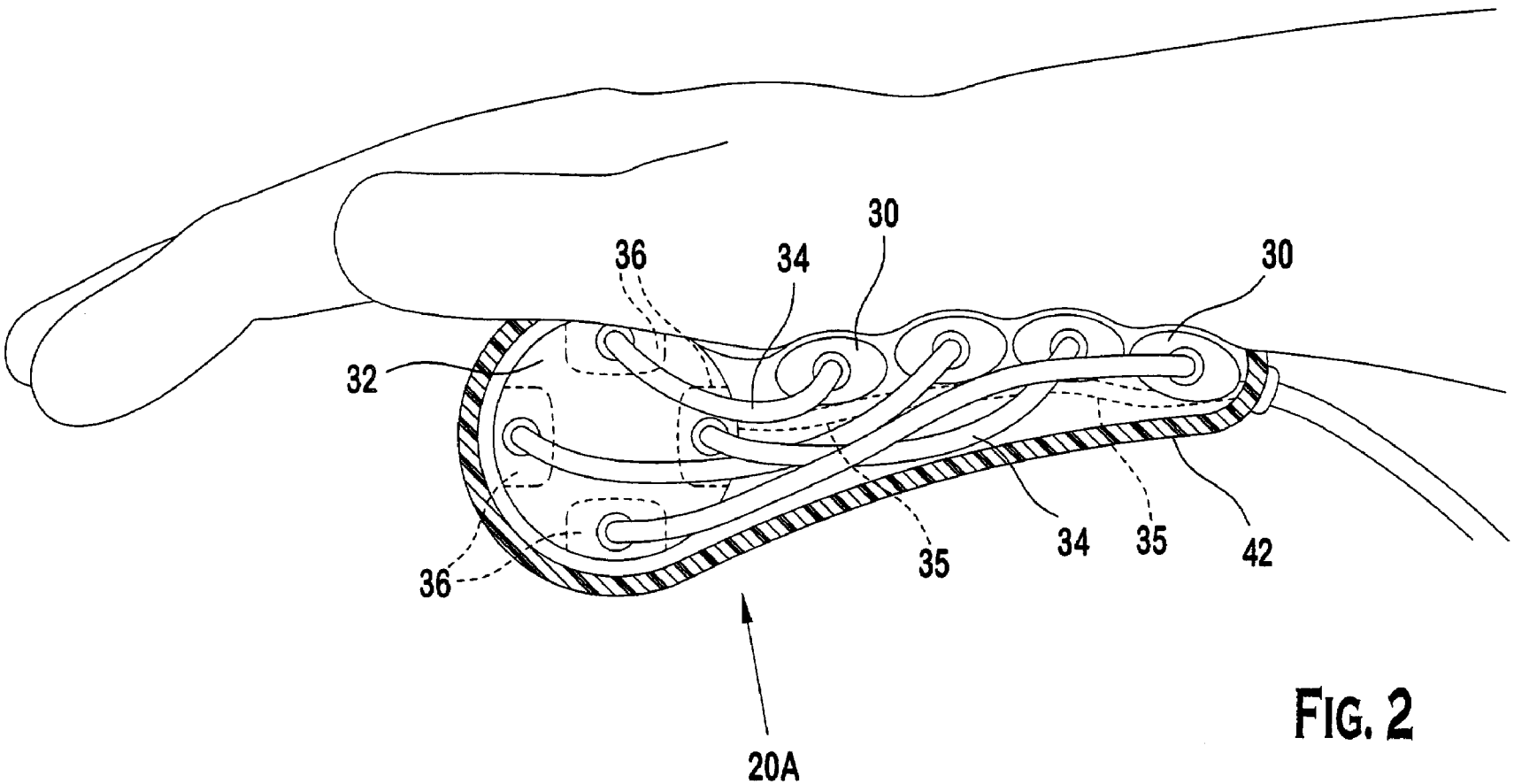
FIG. 2 is side elevational broken away view of the treatment device of FIG. 1 positioned on the hand and wrist of a user.

Referring to FIGS. 1 and 2, the first preferred embodiment of the treatment device 20A preferably uses fluid bladders 30 to apply massage action to a user's hand and/or wrist 22. The fluid bladders 30 are preferably elastomeric ballons that tend to stay unexpanded. Alternatively, a relatively rigid support sheet 35 (shown in broken lines in FIG. 2) can be used to sandwich the fluid bladders 30 between a heating pad 28 and the support sheet 35. The use of a support sheet 35 eliminates the need to use fluid bladders 30 formed by elastomeric ballons that tend to return to an unexpanded state. By modifying the position of the support sheet 35 a user can adjust the pressure created by the device. Heated fluid bladders 30 can be used to provide both heat and massage action to the wrist and hand 22 of the user. It is preferable that the fluid bladders 30 are connected to a pump housing 32 via conduits 34. The conduits 34 are preferably each attached to a separate fluid bellow 36 located within pump housing 32.

A motor 38 preferably rotates a roller 40 such that the roller 40 sequentially depresses one or more of the fluid bellows 36 to force fluid through the conduits 34 and into the corresponding fluid bladders 30. By sequentially depressing one or more of the fluid bellows 36, the roller 40 can inflate the fluid bladders 30 in an alternating fashion to apply massage action and/or heat to the hand and wrist 22 of the user. By compressing the bellows 36 in an alternating fashion, localized, oscillating massage pressure can be applied to the hand and the wrist 22 of the user 22 to provide massage action. Additionally, a heating pad (not shown) can be overlaid on the fluid bladders 30 to allow the application of heat and massage action without using a heated fluid in conjunction with the fluid bladders 30.

Each of the fluid bellows 36 can be positioned about the circumference of the pump housing 32 such that the fluid roller 40 can move through a generally circular path to sequentially inflate each of the fluid bladders 30. While the treatment device 20A preferably has four separate fluid bladders 30, those of ordinary skill in the art will appreciate from this disclosure that any number of bladders 30 can be used with the treatment device 20A without departing from the scope of the present invention.

It is preferred that the pump housing 32 and the fluid bladders 30 be positioned in a device housing 42. The housing 42 is preferably customized to fit under a user's palm and wrist.

The pressure applied by the treatment device 20A to the hand and wrist 22 of the user can preferably be adjusted by increasing or decreasing the length of the arm 44 that supports the roller 40. By increasing the length the arm 44, the roller 40 compresses the fluid bellows 36 to greater extent causing more fluid to be forced into the corresponding fluid bladder 30 which increases pressure on the hand and wrist 22 of the user. Similarly, if the length of the arm 44 is reduced, the amount of compression applied to the fluid bellows 36 is reduced which results in less fluid being forced into the corresponding fluid bladders 30 and less pressure being applied by the device 20A. Those of ordinary skill in the art will appreciate from this disclosure that other known means of increasing the pressure in the fluid bladders 30, such as increasing the amount of fluids used in the treatment device 20A, can be used without departing from the scope of the present invention.

Figure 3:
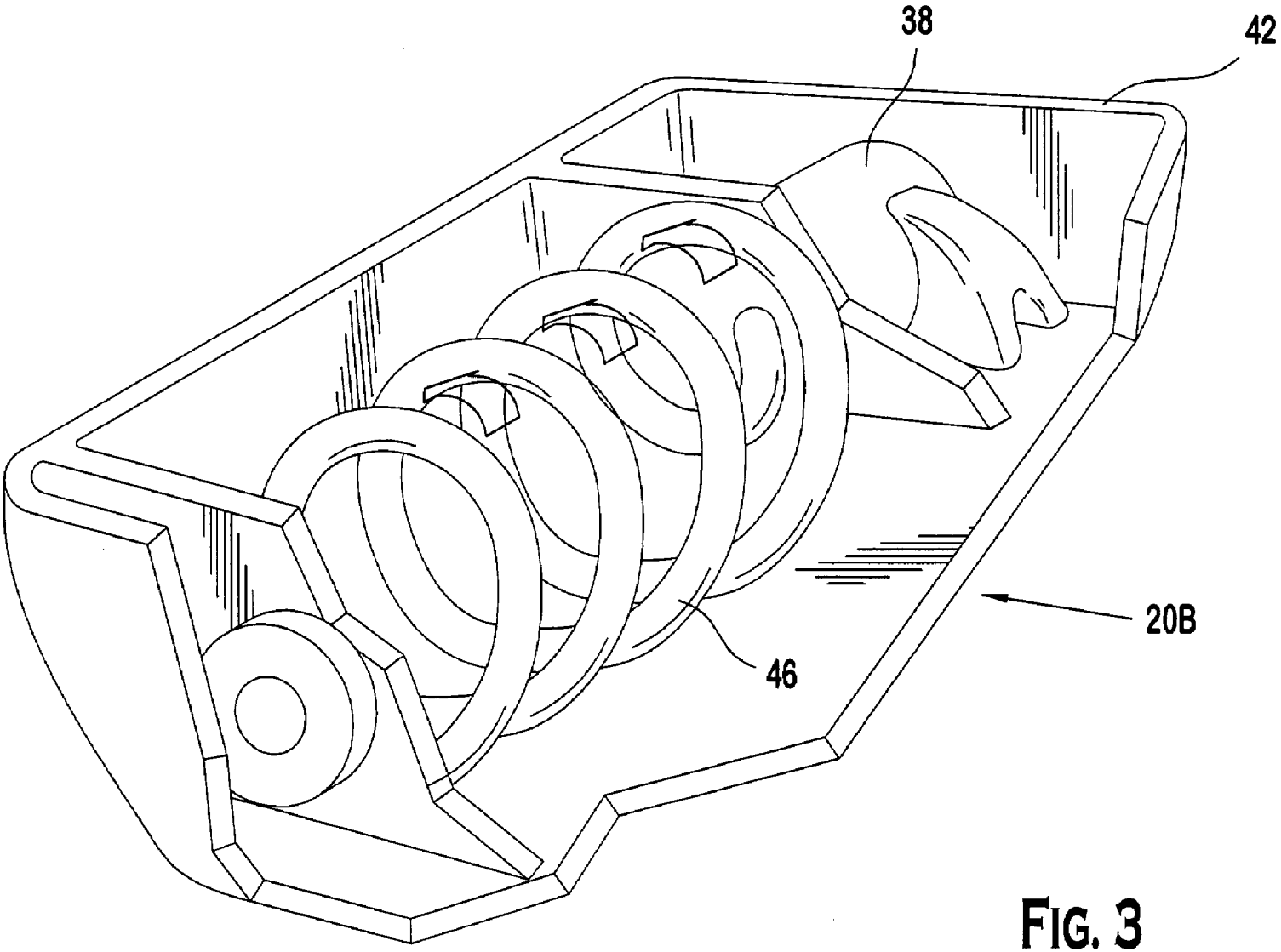
FIG. 3 is a perspective broken away view of a second preferred embodiment of a treatment device according to the present invention, the treatment device preferably uses a coil to apply massage action to the hand and wrist of a user.
Figure 4:
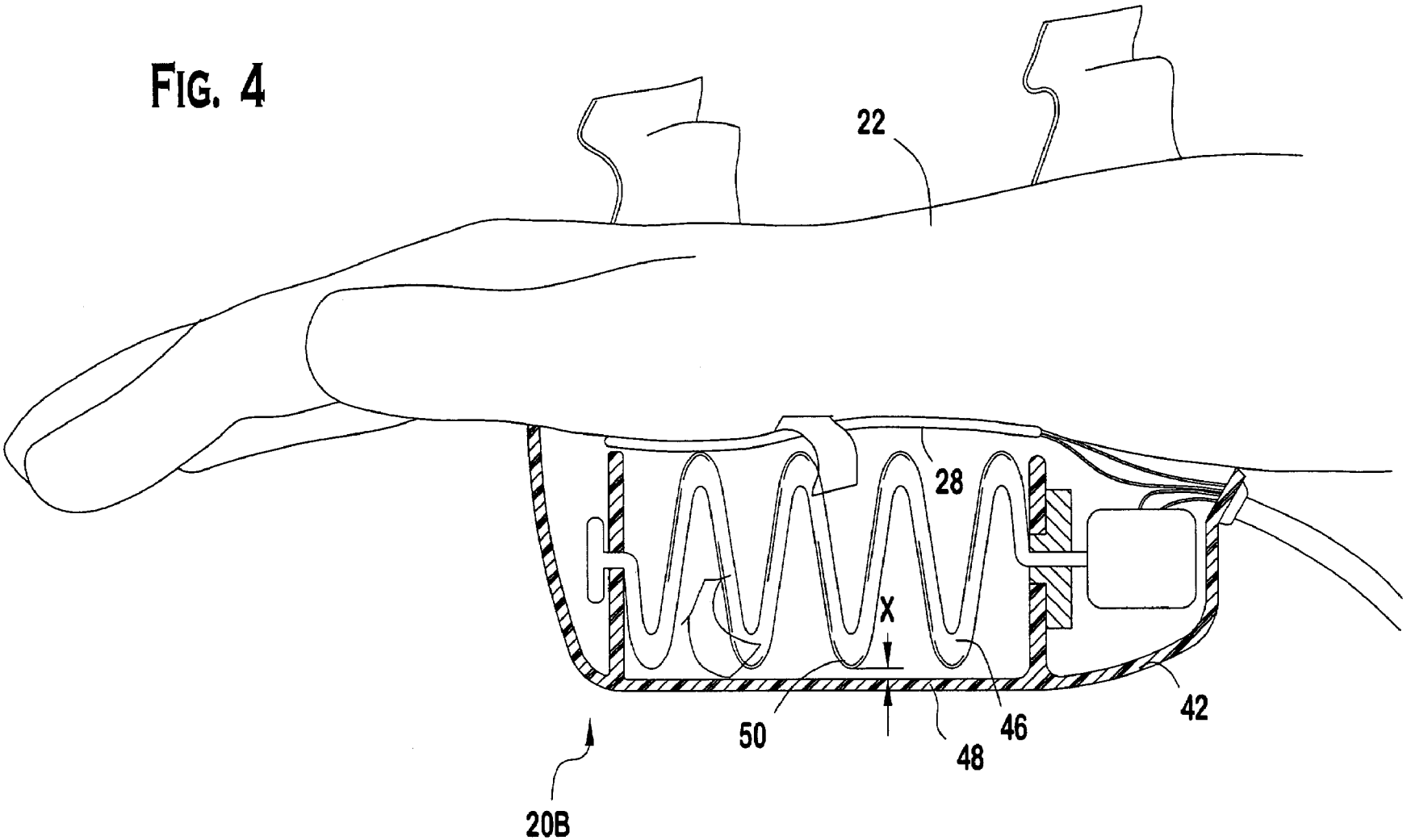
FIG. 4 is side elevational broken away view of the treatment device of FIG. 3 illustrating the placement of the device on the hand and wrist of a user.

Referring to FIGS. 3 and 4, a second preferred embodiment of the treatment device 20B is shown. The treatment device 20B is preferably uses a helical coil 46 to apply area localized, oscillating massage action to the hand and wrist of a user. The helical coil is preferably formed of a durable material such as nylon or the like. A heating pad 28 is preferably positioned over the helical coil 46 to allow heat and massage action to be simultaneously applied to the hand and wrist 22 of the user.

It is preferred that the heating pad 28 has a temperature adjusting control to allow a user to select a comfortable heat treatment temperature. Additionally, the pressure supplied by the treatment device 20B to the hand and wrist 22 of a user can be varied by alternating the distance "X" between the lowermost point of the coil 50 and the base 48 of the housing 42. Additionally, those of ordinary skill in the art will appreciate from this disclosure that a single inflatable bladder can be incorporated into the heating pad to allow the adjustment of pressure without altering the distance "X" between the coil 46 and the base 48 of the housing 42.

Figure 5:
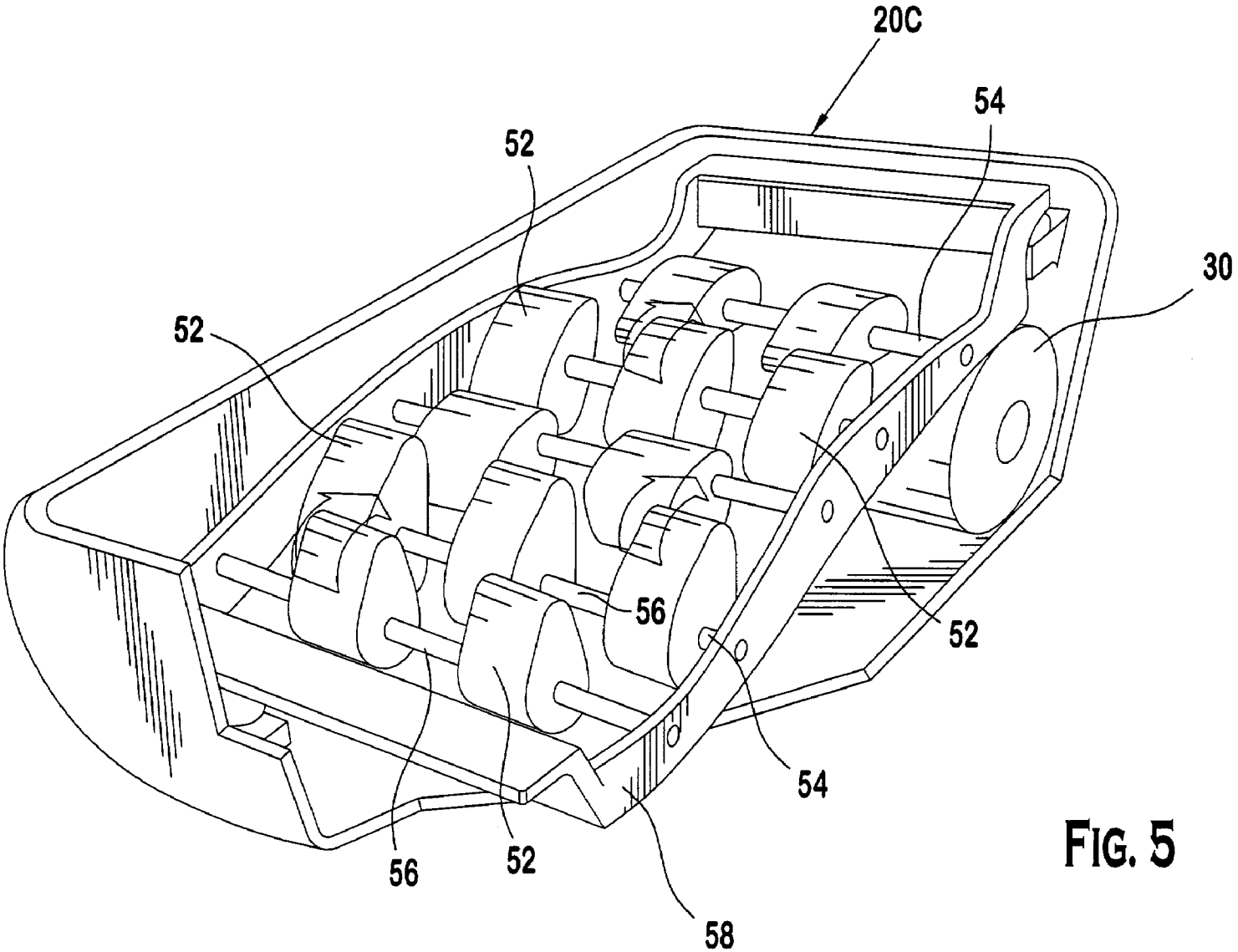
FIG. 5 is a perspective broken away view of a third preferred embodiment of a treatment device according to the present invention, the treatment device preferably uses rotating cams to apply massage action to the wrist and hand of a user.
Figure 6:
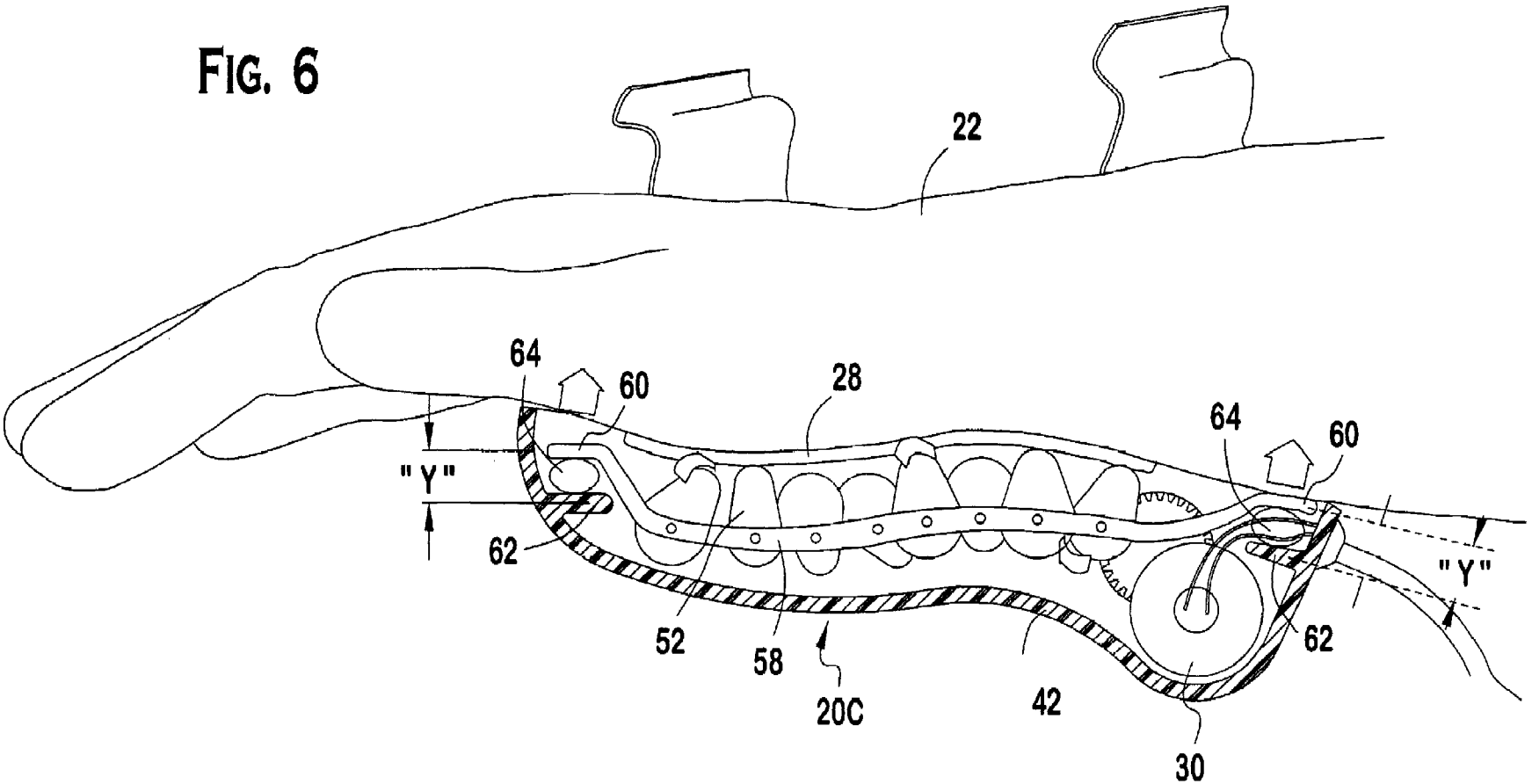
FIG. 6 is a side elevational broken away view of the treatment device of FIG. 5 illustrating the treatment device positioned on the hand and wrist of a user.

Referring to FIGS. 5 and 6, the third preferred embodiment of the treatment device 20C is shown. The treatment device 20C preferably uses multiple cams 52 that are rotated to create area localized, oscillating wave-like massage action on the hand and wrist 22 of the user. Cams 52 are preferably spaced apart to form individual rows 54 to allow portions of the cams 52 in adjacent rows 54 to be partially interdigitated during portions of their rotation. Each row of cams 54 is preferably supported on a single axle 56 that is rotatably secured in a frame 58. It is preferred that a single drive train rotate each of the axles 56 to create oscillating massage action. The drive train is powered by the motor 30.

A heating pad 28 can be positioned over the cams 52 to allow heat and/or massage action to be applied to the hand and wrist 22 of a user. Those of ordinary skill in the art will appreciate that the speed at which the cams 52 are rotated is preferably variable depending on the massage action desired by a user.

The pressure applied by the treatment device 20C can be varied by adjusting the distance "Y" between the lateral end 60 of the frame 58 and an interior housing shoulder 62. The distance "Y" be can be adjusted by inflating/deflating air bladders 64 using a hand pump or the like. This distance can also be adjusted by selecting suitable springs 64 that can be substituted for the air bladders 64 that are positioned between the shoulders 62 and the laterally ends 60 of the frame 58. Additionally, a fluid bladder can be or incorporated into the heating pad 28 to alter the pressure supplied to the hand and wrist of 22 of a user by treatment device 20C.

While each of the cams 52 is shown as having generally the same shape and size, those of ordinary skill in the art will appreciate that the cams 52 can have varying shapes and sizes without departing from the scope of the present invention. Additionally, the number of rows 54 and/or cams 62 within each row 54 can be varied without departing from the scope of the present invention.

Figure 7:
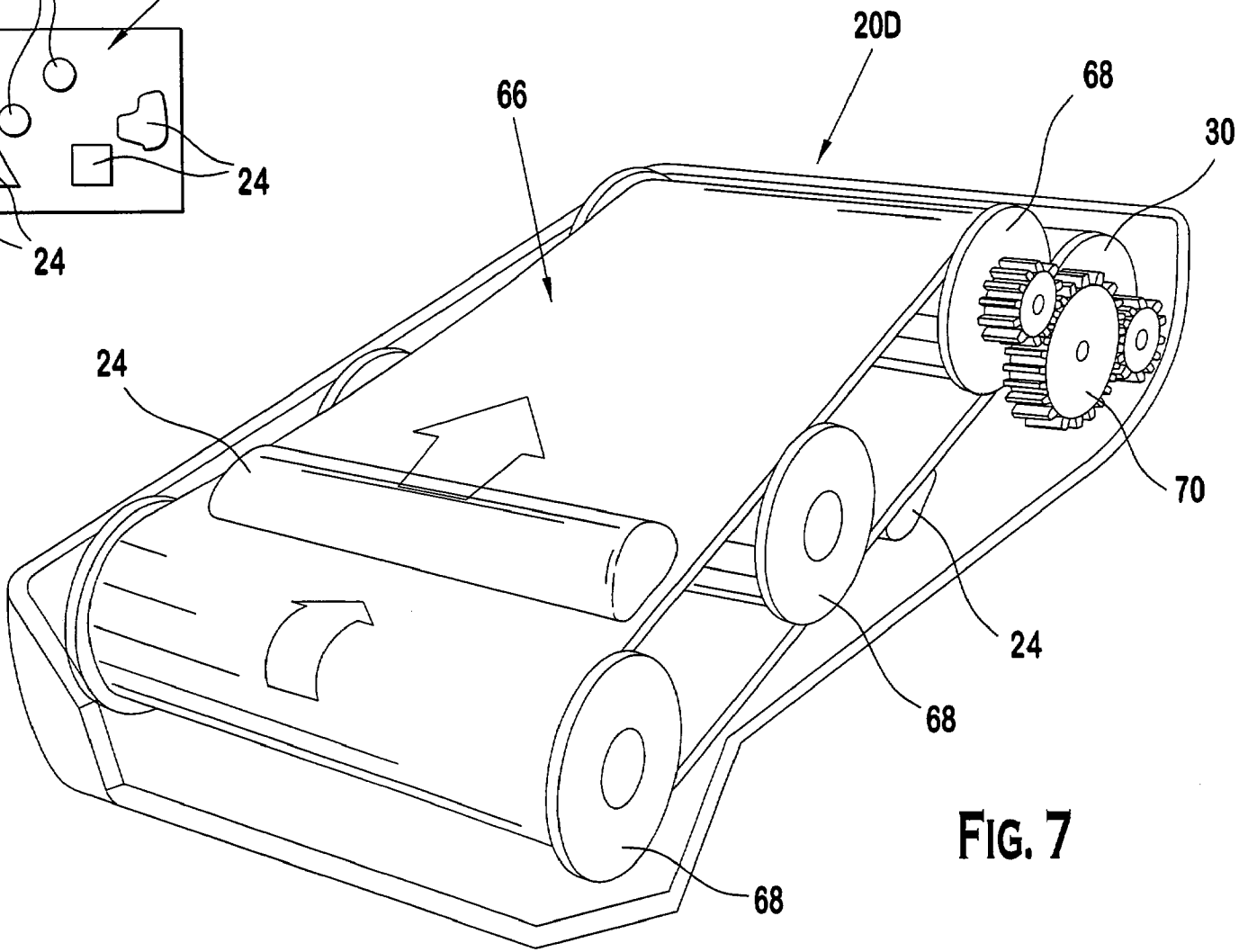
FIG. 7 is perspective broken away view of a fourth preferred embodiment of a treatment device according to the present invention, the treatment device preferably uses a conveyor belt having at least one protuberance thereon to apply massage action to the hand and wrist of a user.
Figure 7A:
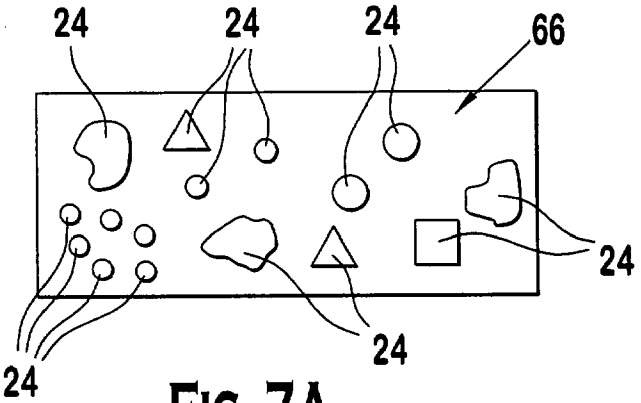
FIG. 7A is a schematic view of an alternate protuberance configuration for the conveyor used with the treatment device of FIG. 7.
Figure 8:
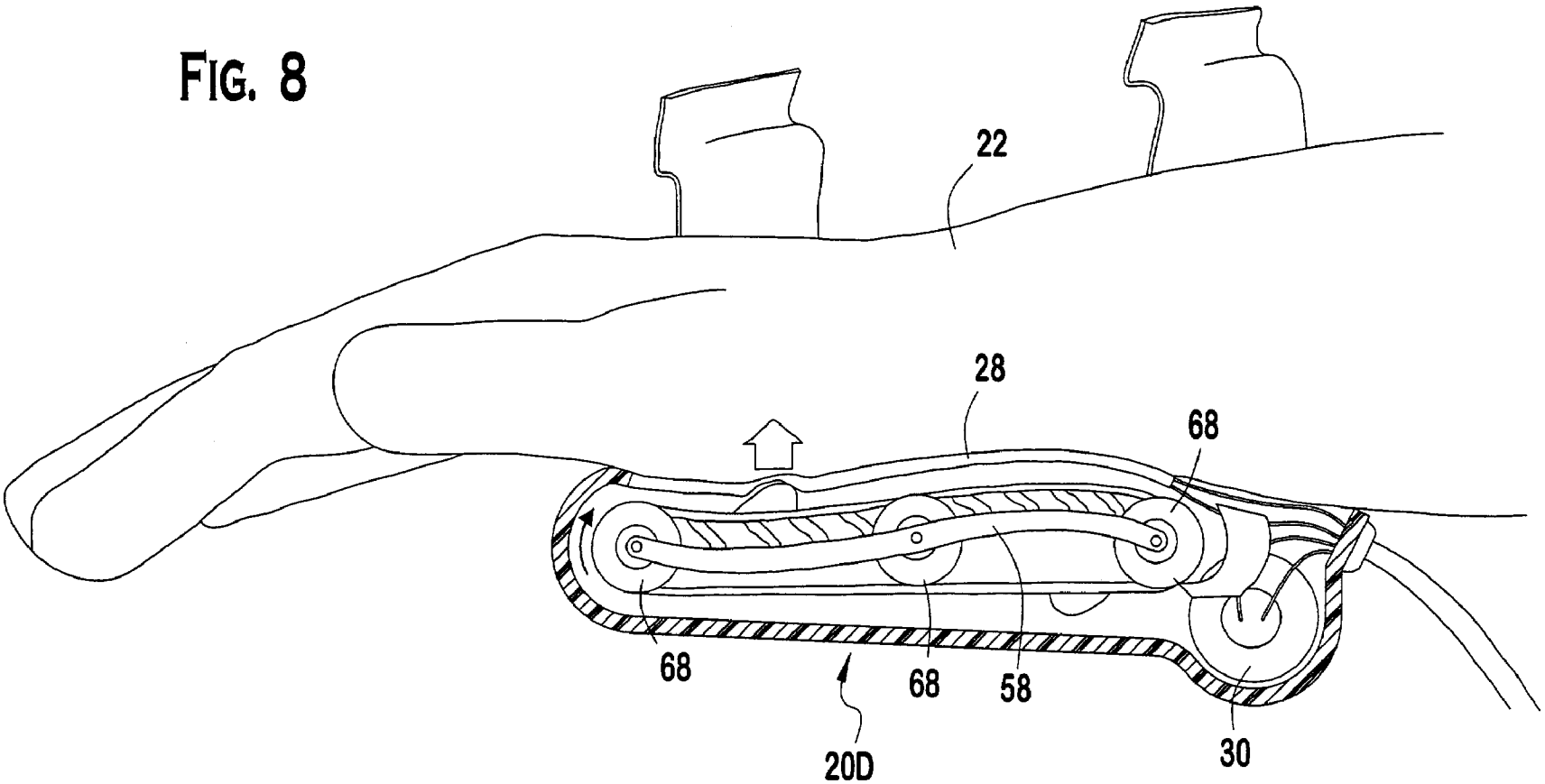
FIG. 8 is side elevational broken away view of the treatment device of FIG. 7 positioned on the hand and wrist of a user.

Referring to FIGS. 7 and 8, a fourth preferred embodiment of the treatment device 20D of the present invention is shown. The treatment 20D preferably uses a conveyor 66 to move at least one protuberance 24 from one side of the treatment device 20D toward the opposing side of the treatment device 20D. It is preferred that the protuberances 24 extend laterally across the conveyor 66 and are formed by gel sacks, finger-like springs, rubber nubs, or the like. However, those of ordinary skill in the art will appreciate that the protuberances 24 can be formed in various sizes and shapes without departing from the scope of the present invention. Accordingly, the proturberances 24 can be positioned in random configurations similar to that shown in FIG. 7A without departing from the scope of the present invention.

The conveyor 66 is preferably positioned about rollers 68 and is driven by the motor 30. The motor 30 is preferably connected to one of the rollers 68 via suitable gearing 70. However, those of ordinary skill in the art will appreciate from this disclosure that a drive chain can be used in conjunction with the conveyor 66 to allow the 30 motor to drive each of the rollers 68 simultaneously. It is preferable that a user can adjust the speed and direction of the conveyor 66.

A heating pad 28 can be positioned over the conveyor 66 to allow the simultaneous application of heat and massage action. Additionally, a fluid bladder can be positioned over or incorporated into the heating pad 28 to allow a user to adjust the pressure applied to the hand and wrist 22 of the user. Furthermore, the frame 58 that supports the rollers 68 can be modified to include air bladders in a similar fashion to that shown in connection with the third preferred embodiment of the treatment device 20C to allow a user to adjust the pressure supplied by the treatment device 20D.

Figure 9:
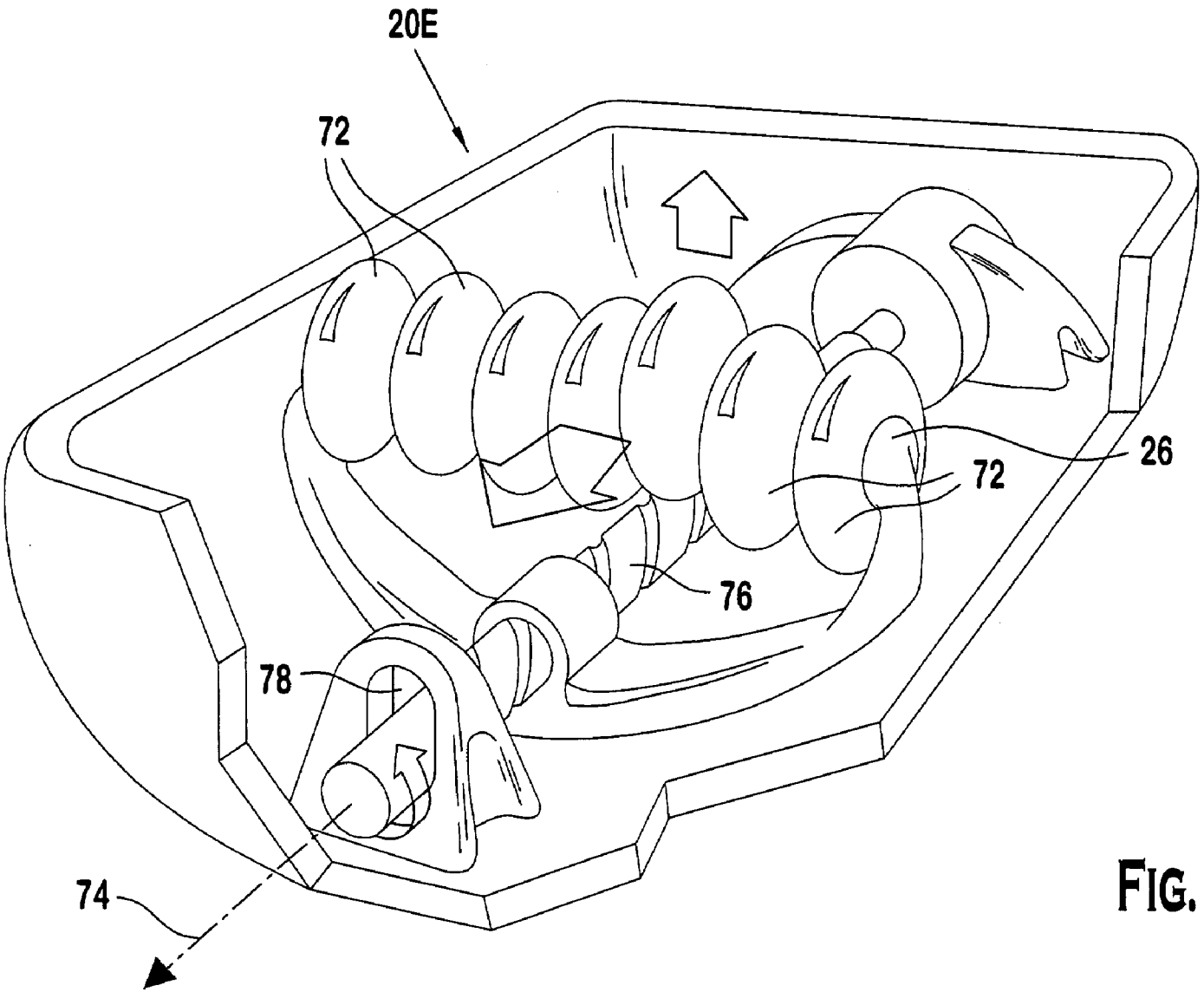
FIG. 9 is a perspective broken away view of a fifth preferred embodiment of the treatment device according to the present invention, the treatment device preferably uses an oscillating massage member to apply massage action to the hand and wrist of a user.
Figure 10:
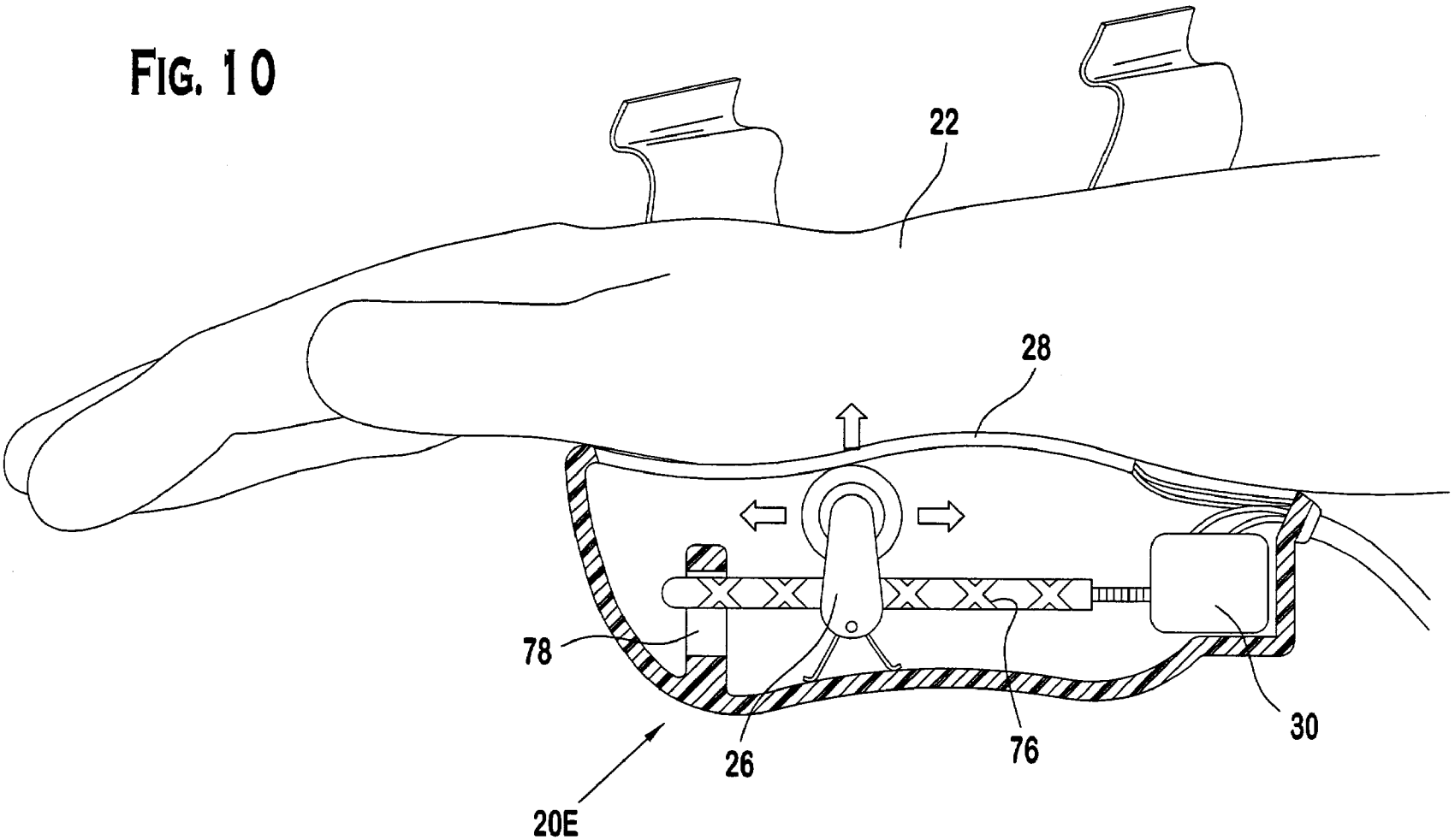
FIG. 10 is side elevational broken away view of the treatment device of FIG. 9 positioned on the hand and wrist of a user.
Figure 11:
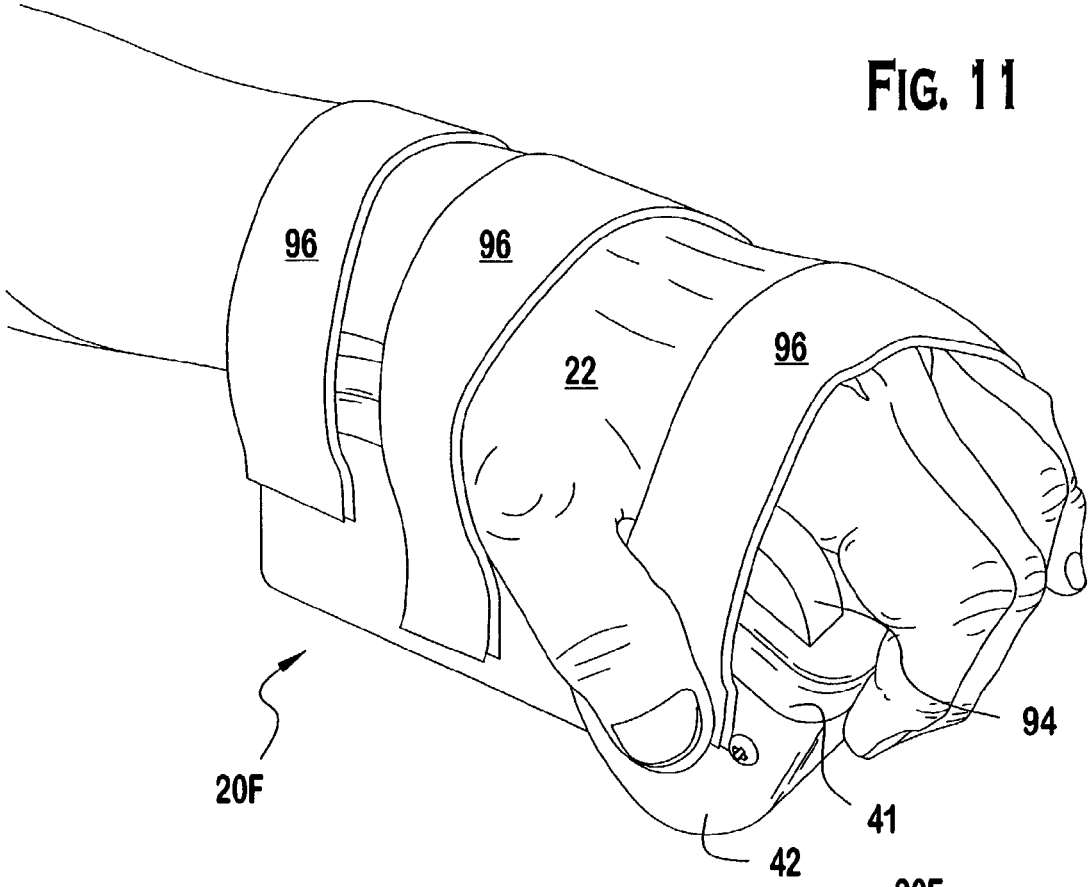
FIG. 11 is a perspective view of a sixth preferred treatment device according to the present invention attached to a user's hand via hook and loop material.
Figure 12:
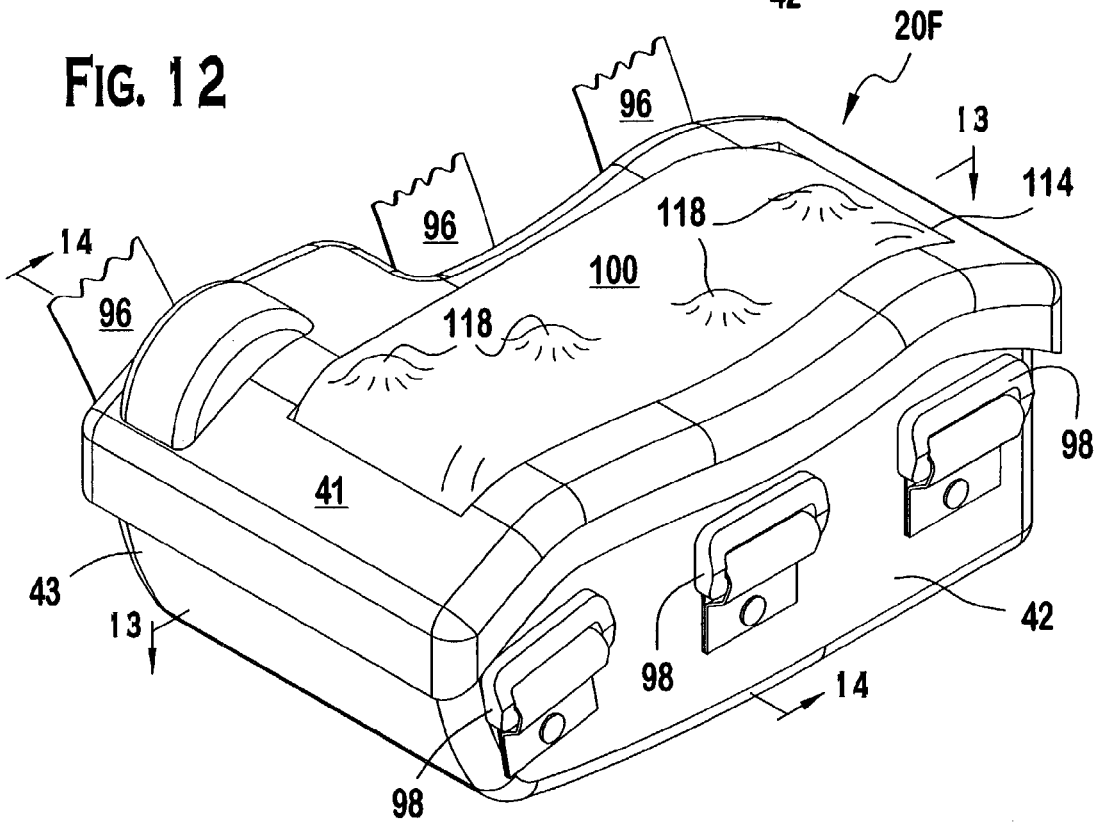
FIG. 12 is a perspective view of the treatment device of FIG. 11 illustrating the fabric and massaging nodules that apply massage to the user.

Referring to FIGS. 9 and 10, the fifth preferred embodiment of the treatment device 20E is shown. The treatment device 20E preferable uses a massage member 26 to support oblong shaped balls 72. While a preferred number and configuration of balls 72 are shown, those of ordinary skill in the art win appreciate from this disclosure that any number or shape of balls 72 can be used with the massage member 26 without departing from scope of the present invention. The massage member 26 can be moved in a reciprocating fashion along the longitudinal axis 74 of the treatment device 20E to apply area localized, oscillating massage action to the hand and wrist 22 of a user. The massage member 26 is preferably driven by a worm gear 76. However, those of ordinary skill in the art will appreciate that any known method of reciprocating the massage member 26 along the longitudinal axis 74 of the treatment device 20E can be used without departing from the scope of the present invention.

A heating pad 28 is preferably positioned over the balls 72 to allow the simultaneous application of heat and massage action. Additionally, a fluid bladder can be incorporated into the heating pad 28 to allow a user to adjust the pressure exerted onto the hand and wrist 22 of the user. Additionally, the position of the worm gear 76 within a slot 78 can be vertically adjusted to increase or decrease the pressure supplied by the treatment device 20E to the hand and wrist 22 of a user.

A sixth preferred embodiment of the treatment device 20F of the present invention is shown in FIGS. 11–15. The treatment device 20F preferably includes a housing 42 having a surface defined at least partially by a membrane 100 adapted for placement against the user's hand and/or wrist 22. The housing preferably includes a top plate 41 that is secured over at least some edges of the membrane 100. The top plate 41 is preferably generally rectangular and includes a generally centrally located aperture 114 through which a portion of the membrane 100 protrudes. As mentioned above, the membrane 100 may be formed by a portion of a heating pad or the like.

The housing top plate 41 is preferably secured to the housing base via fasteners 104. Alternatively, the housing top plate 41 can be secured to the housing via a snap fit, hook and loop material, or the like. The housing 42 preferably includes a gear box 43 which houses a gear train 82 (further described below) therein.

It is preferred that separate portions of a major surface of the membrane 100 are independently supported from within the treatment device 20F such that the separate portions can be depressed in varying amounts depending on a shape of the user's hand and/or wrist 22 when the treatment device 20F is positioned with the membrane 100 against the user's hand and/or wrist 22.

Figure 15:
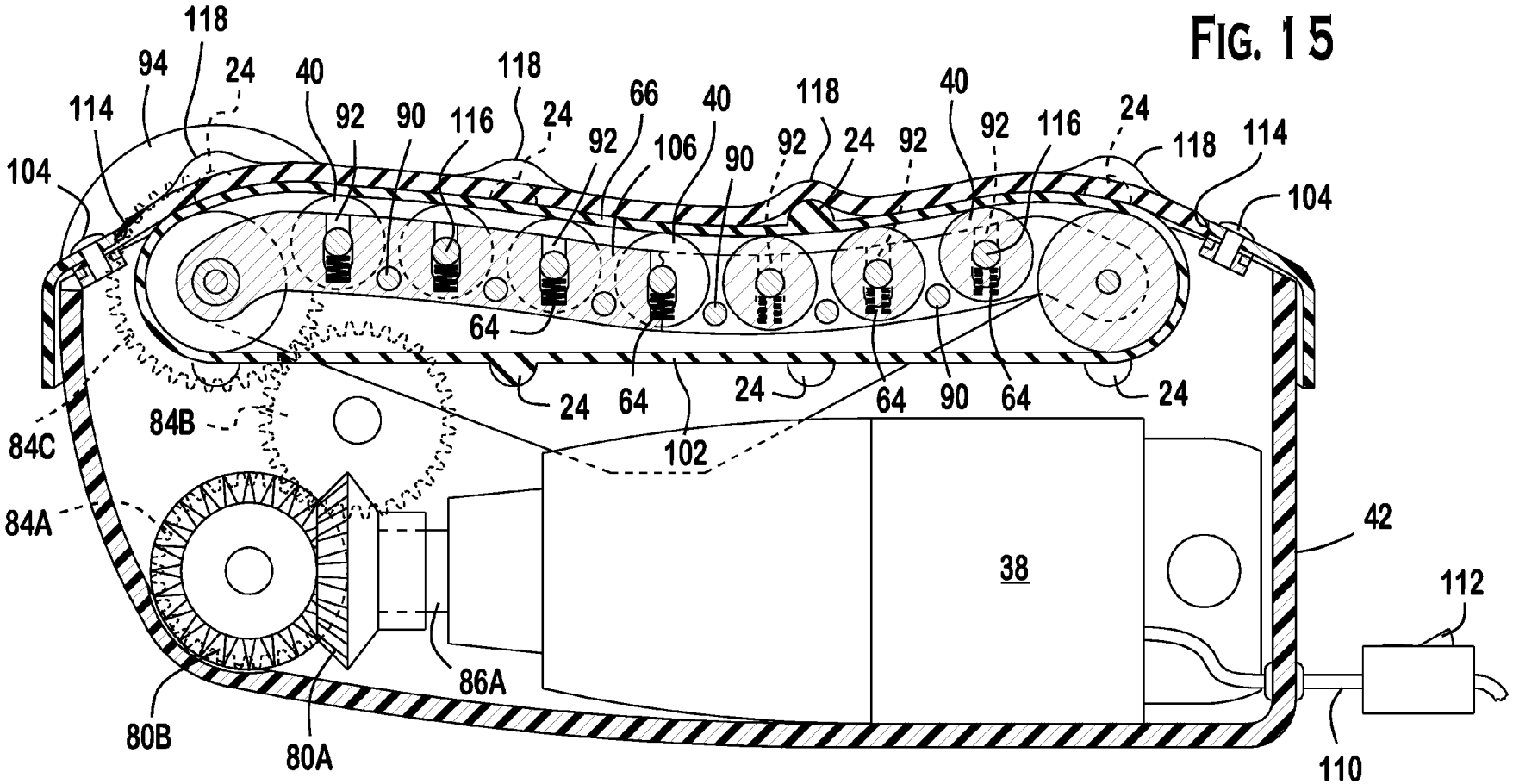
FIG. 15 is a cross-sectional view of the treatment device of FIG. 13 as taken along the line 15—15 of FIG. 13 illustrating the independent suspension of the rollers using springs that are located in bores beneath the roller axles.

It is preferred that the membrane 100 is supported, directly or indirectly, by a plurality of rollers 40 that are disposed in the housing 42 proximate to the membrane 100. Referring specifically to FIG. 15, it is preferred that at least two of the rollers 40 are independently supported in the housing 42 and are independently biased toward the membrane 100.

Figure 13:
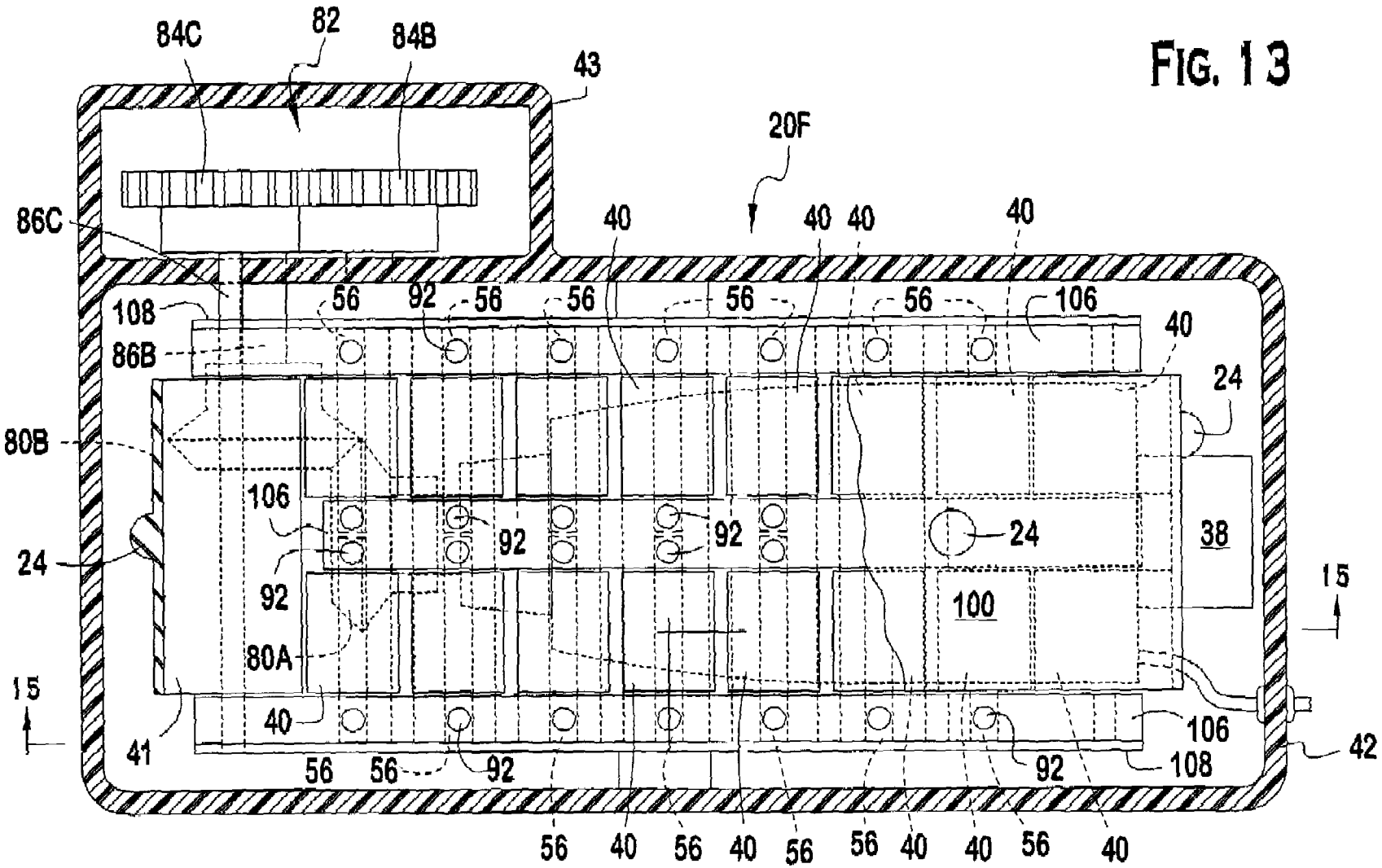
FIG. 13 is cross-sectional view of the treatment device of FIG. 12 as taken along the line of 13—13 of FIG. 12 illustrating a dual row of independent suspension rollers that allows the treatment device to be used comfortably by a variety of users.
Figure 14:
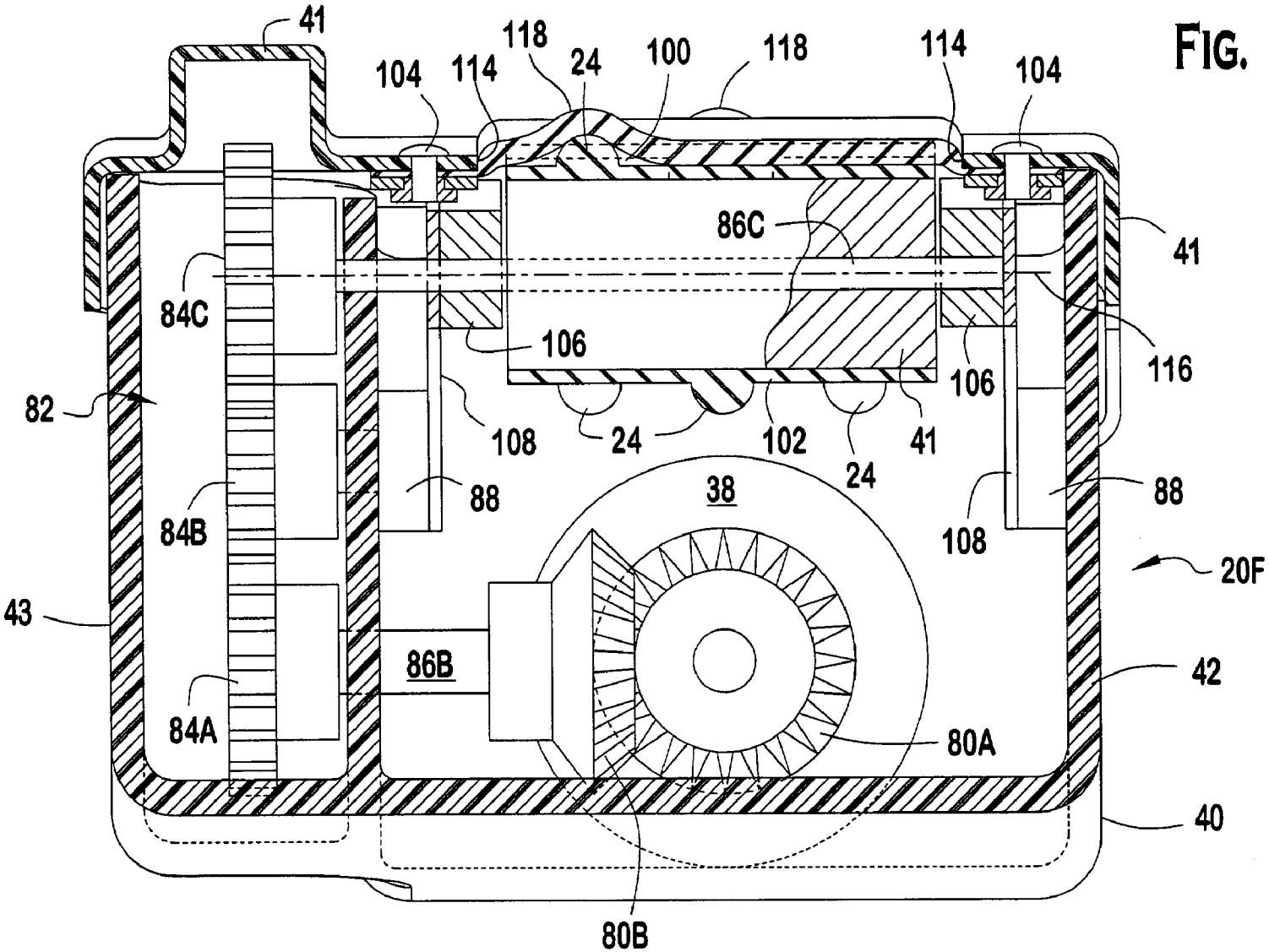
FIG. 14 is a cross-sectional view of the treatment device of FIG. 12 as taken along the line 14—14 of FIG. 12 illustrating the placement of the rollers and conveyor belt above a motor that is connected to a drive motor via first and second bevel gears and a gear train.

Referring to FIGS. 13 and 15, the two independently suspended rollers 40 are preferably biased by at least one elastic member 64. More preferably, the rollers 40 have an axle with first and second ends rotatably supported in the housing 42. The first and second axles ends are each preferably located in a separate groove 92 in housing axle supports 106. The axle supports 106 are preferably shaped to complement the shape of the housing top plate 41. Two outer axle supports 106 are preferably connected to the main housing body 42 via side frames 108 that are connected to the main housing body 42 via support blocks 88 (as best shown in FIG. 14). A central axle support 106 allows rollers to be aligned along a common axis of rotation 116 while still being independently suspended by springs 64.

The axle supports 106 preferably include multiple slots, or grooves, 92 which each preferably contain an elastic member 64 positioned between a bottom of the slot 92 and the lower side of the axle 56 to bias the axle 56 generally toward the membrane 100. While a preferred housing structure has been described above for supporting the rollers 40, those of ordinary skill in the art will appreciate that various housings can be used without departing from the scope of the present invention.

It is preferred that the end rollers 40 extend the across the conveyor 66 (further described below) width (the conveyor width extends across the conveyor 66 from the top to the bottom as shown in FIG. 13) to provide smooth conveyor movement. The interior rollers 40 each preferably extend only partway across the width of the conveyor 66. While the preferred embodiment uses interior rollers 40 arranged in pairs that are each aligned along a common axis of rotation 116, those of ordinary skill in the art will appreciate from this disclosure that the interior rollers 40 can be arranged singly or in groups of three or more without departing from the present invention. By aligning multiple independently suspended rollers 40 along a common axis of rotation 116 in an end-to-end fashion, the rollers 40 create an adjustable supporting surface for the membrane 100. This allows different portions of the membrane 100 to be depressed to varying degrees depending on the shape of a user's hand to allow the user to comfortably fit the treatment device 20F to his or her hand and/or wrist 22. As such, the membrane 100 includes multiple portions that can be depressed to different degrees when moving along the conveyor in either a longitudinal direction or in the direction of the conveyor width. Thus, the membrane 100 is not just able to adjust to hand shapes that occur between the wrist and the fingers, but can also adjust for differences in lateral hand shape (i.e., for changes in the hand as one moves along the hand in a direction generally askew to the forearm). The only limit to the amount of variability and customization of the treatment device 20F is the number of separately supported portions of the membrane 100 resulting from increased numbers of rollers 40 or the like.

A conveyor 66 is preferably located around the plurality of rollers 56 such that at least one of the rollers 56 presses the conveyor 66 into contact with the membrane 100. At least one protuberance 24 (which can have any shape or be organized in any pattern as described above) is preferably disposed on the conveyor 66. The conveyor 66 is preferably a conveyor belt, but can be any other type of conveyor without departing from the scope of the present invention. The at least one protuberance 24 creates localized outwardly deformations 118 in the membrane 100 when in contact therewith such that rotation of the conveyor 66 is adapted to create a massaging effect for the user's hand and/or wrist due to the localized outwardly deformations 118 created by the at least one protuberance 24.

Referring to FIGS. 14 and 15, the rollers 40 are preferably driven by a motor 38. The motor 38 is preferably powered by electricity delivered via a cord 100 having an integrated on/off switch 112. However, the motor 38 can be powered by energy provided by an onboard fuel source or those types of engines described above without departing from the present invention.

The motor 38 drives a first drive shaft 86A that is connected to a first beveled gear 80A. The first beveled gear 80A is preferably in communication with a second beveled gear 80B which is connected to the gear train 82 via a second drive shaft 86B. The second drive shaft 86 B extends into the gear box 43 and drives the first gear 84A. The first gear 84A is in communication with the second gear 84B which is communication with the third gear 84C which rotates the third drive shaft 86C. The third drive shaft 86C extends from the gear box 43 into the main portion of the housing 42 and drives the drive roller 40 which is preferably located at one end of the roller arrangement. Depending on the configuration of the gear train 82, the housing 42 may include a bump out portion 94 to allow a portion of the gear train to extend generally past the housing top plate 41. While a preferred drive mechanism has been described for the treatment device, those of ordinary skill in the art will appreciate from this disclosure that any known suitable drive mechanism can be used without departing from the present invention.

The membrane 100 can be formed by a surface portion of a heat pad so that the treatment device 20F is adapted to apply both heat and massage to the user's hand and/or wrist 22. Alternatively, the heat generating pad can be located between the conveyor 66 and the membrane 100.

While various features and mechanisms for applying massage action and/or heat to the hand and wrist 22 of a user have been described above in connection with the five preferred embodiments of the treatment device 20A–20F, those of ordinary skill in the art will appreciate from this disclosure that any combination of the above described features and structural components can be used in a single treatment device without departing from the scope of the present invention. Additionally, the treatment devices 20A–20F can be configured to have different lengths to extend along different amounts of a user's hand, wrist, and/or arm depending on the age and size of the user. By preferably massaging from the underside of a user's palm and moving toward and over the wrist (or the reverse) an effective massage action for treating hand and wrist ailments is generated.

The treatment device 20A–20F of the present invention provides a highly versatile home treatment device for carpal tunnel syndrome, tendinitis, and other hand and wrist ailments. It is recognized by those skilled in the art, that changes may be made to above described embodiments without departing from the broad inventive concept thereof. For example, the treatment device 20A–20F can be configured to apply massage and heat in an alternating fashion, simultaneously, or in any other combinations. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A treatment device for a user's hand and/or wrist, the treatment device comprising:

a housing having a surface defined at least partially by a membrane adapted for placement against the user's hand and/or wrist, wherein separate portions of a major surface of the membrane are independently supported such that the separate portions can be depressed in varying amounts depending on a shape of the user's hand and/or wrist when the treatment device is positioned with the membrane against the user's hand and/or wrist;

a plurality of rollers disposed in the housing proximate to the membrane, at least two of the plurality of rollers being independently supported in the housing and independently biased toward the membrane, each of the at least two of the plurality of rollers are biased by at least one elastic member, wherein each of the at least two of the plurality of rollers have an axle with first and second ends rotatably supported in the housing, each of the first and second ends being located in separate grooves in the housing with an elastic member positioned in each of the separate grooves to bias the axle generally toward the membrane.

2. The treatment device of claim 1, further comprising:

a conveyor located around the plurality of rollers such that at least one of the plurality of rollers press the conveyor into contact with the membrane; and at least one protuberance disposed on the conveyor, the at least one protuberance creating localized outwardly deformations in the membrane when in contact therewith such that rotation of the conveyor is adapted to create a massaging effect for the user's hand and/or wrist due to the localized outwardly deformations created by the at least one protuberance.

3. The treatment device of claim 2, wherein the membrane is heated so that the treatment device is adapted to apply both heat and massage to the user's hand and/or wrist.

4. The treatment device of claim 2, further comprising a heat generating pad located between the conveyor and the membrane.

5. The treatment device of claim 2, wherein the membrane is part of a heat generating pad.

6. The treatment device of claim 1, wherein the membrane is formed of a polymer.

7. The treatment device of claim 1, wherein the membrane is formed of an elastomer.

* * * * *